United States Patent [19]

Ulbricht et al.

[11] 4,339,892

[45] Jul. 20, 1982

[54] SAFETY WINDOW OF THE TILT AND TURN TYPE

[75] Inventors: Roger Ulbricht, Hicksville; Ralph Cavalucci, New York, both of N.Y.

[73] Assignee: Flour City Architectural Metals, Glen Cove, N.Y.

[21] Appl. No.: 195,408

[22] Filed: Oct. 9, 1980

[51] Int. Cl.[3] ..... E05D 15/52

[52] U.S. Cl. ..... 49/192

[58] Field of Search ..... 49/192, 394, 395, 193

[56] References Cited

U.S. PATENT DOCUMENTS

| | | | |
|---|---|---|---|
| 3,004,304 | 10/1961 | Frank | 49/192 |
| 3,368,306 | 2/1968 | Von Wedel et al. | 49/192 |
| 3,434,238 | 3/1969 | Müller | 49/192 |
| 3,667,162 | 6/1972 | Lalagüe | 49/192 |
| 3,802,124 | 4/1974 | Guerrini | 49/192 |
| 3,911,621 | 10/1975 | McHeffey | 49/192 |
| 4,074,462 | 2/1978 | McHeffey | 49/192 |

*Primary Examiner*—Philip C. Kannan

*Attorney, Agent, or Firm*—Mark T. Basseches; Paula T. Basseches

[57] ABSTRACT

The present invention is directed to a window of the tilt and turn type which may selectively be positioned in a locked condition wherein the window member is in coplanar alignment with the frame; in a vent position whereat the window is tiltable about a horizontal axis adjacent the lower edge thereof; and a casement position whereat the window may be pivoted about a vertical axis, as for cleaning. The device is characterized in that the operating mechanism controlling the various conditions of operation of the window is provided with safety interlock means whereby the window may not be dislodged from its normal operating conditions by inadvertent or improper actuation of the operating handle.

8 Claims, 12 Drawing Figures

FIG.4
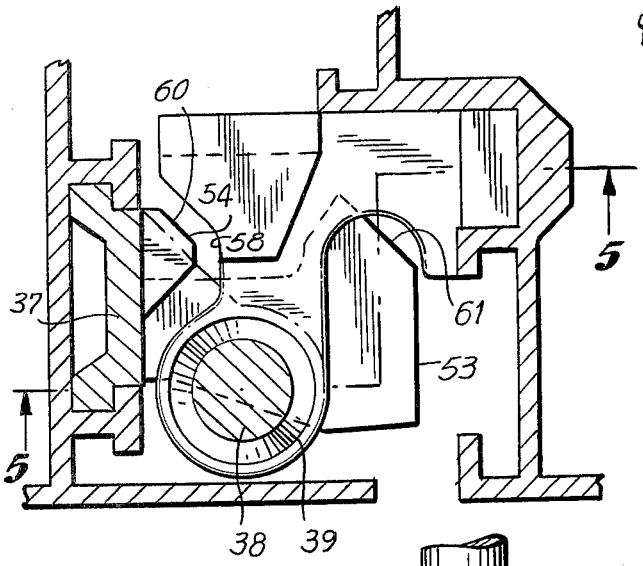
FIG.5
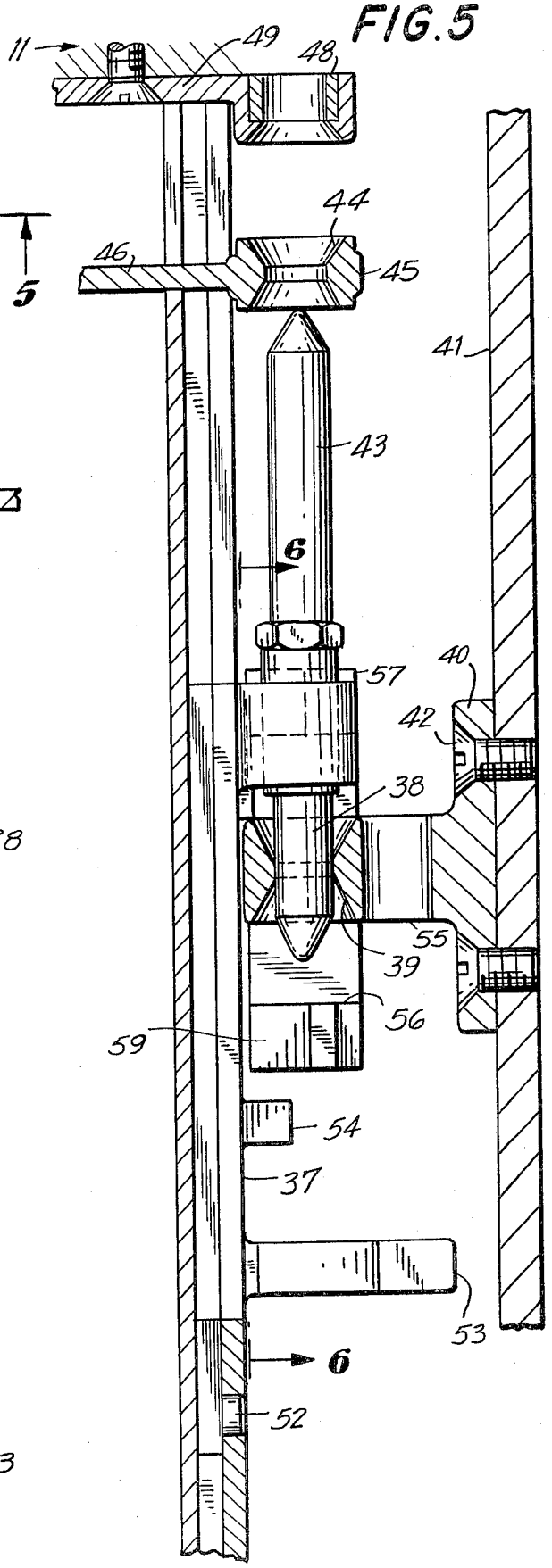
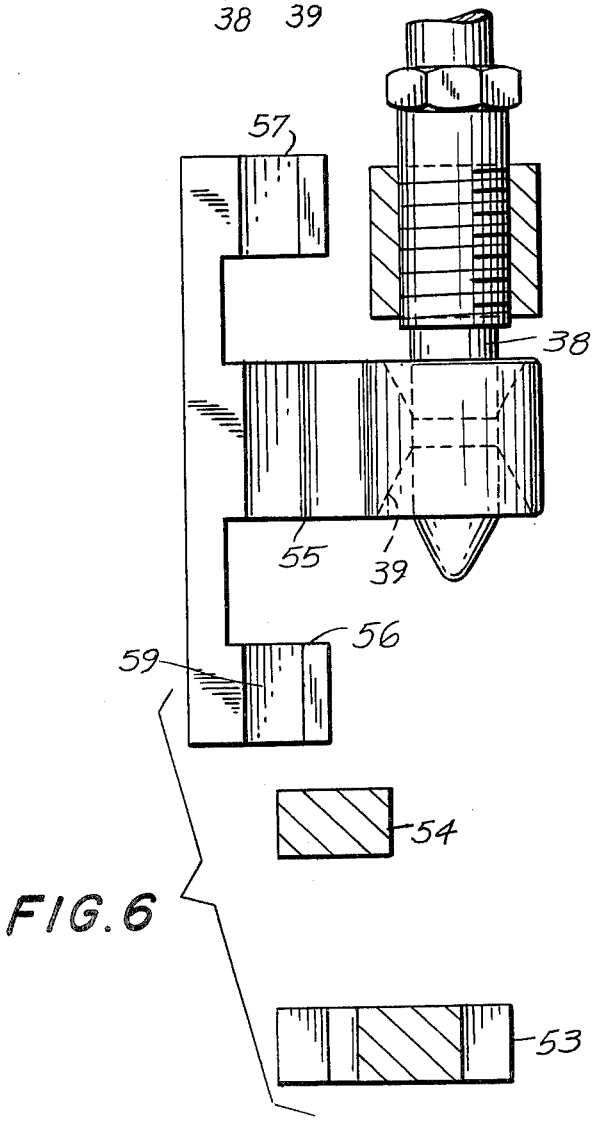
FIG.6

SAFETY WINDOW OF THE TILT AND TURN TYPE

BACKGROUND OF THE INVENTION

1. Field of the Invention

The present invention is in the field of window devices, and more particularly pertains to a window device of the type which is capable of being tilted inwardly about a horizontal pivot axis coincident with the lower edge of the window sash for venting, and also pivotal about a vertical axis so as to function in the manner of a casement window, particularly to provide access to the exterior of the window from the interior of an enclosed space so as to facilitate cleaning.

2. The Prior Art

Windows of the tilt and turn type have come into progressively increasing use in office buildings, institutions and like applications. Window constructions of the type described are shown in United States patents as follows:

| | | |
|---|---|---|
| 2006,004 | Wenzel | June 25, 1935 |
| 2866,635 | Frank | Dec. 30, 1958 |
| 2969,566 | Mayer | Jan. 31, 1961 |
| 3004,304 | Frank | Oct. 17, 1961 |
| 3308,579 | Thams | Mar. 14, 1967 |
| 3368,306 | von Wedel | Feb. 13, 1968 |
| 3434,238 | Muller | Mar. 25, 1969 |
| 3667,162 | Lalague | June 6, 1972 |
| 3802,124 | Guerrini | Apr. 9, 1974 |
| 3867,790 | Frank | Feb. 25, 1975 |
| 3911,621 | McHeffey | Oct. 14, 1975. |

While the window constructions of the above identified references differ in detail, they are all directed to an assembly which comprises a frame, a pane carrying sash mounted in the frame and means for adjusting the window sash into different conditions of operation, namely, a locked condition, a venting condition and a casement condition.

Certain of the references, notably U.S. Pat. Nos. 3,911,621 and 3,667,162, and perhaps others, disclose advanced structures wherein a single handle controls the operating configuration of the sash and also provides the means whereby the operator may physically move the sash to an inward tilted position for venting and may pivot the sash about a vertical pivot axis where the window is used in a casement mode or for cleaning.

Devices of the type described, and particularly those devices controlled by a single operating handle, function, as does the device of the instant application, by connecting the pivotal operating handle to a drive means or mechanism located within the hollow pane carrying sash component. In the locked position, bars, stops or strike members extend between the sash frame and a fixed frame, precluding relative movement of these parts. When the operating handle is shifted to the venting position, the drive means is actuated to withdraw the locking means from spanning relation of the sash and frame, and functions to engage the components of a pivotal connection whereby the sash may be tilted about a horizontal axis coincident with the lower edge of the sash. Typically, in the venting position the device is provided with means for limiting the inward swinging movement of the sash so that the same cannot fall inwardly. See, for instance, U.S. Pat. No. 3,911,621.

When the device is actuated to a casement condition by rotation of the operating handle, certain of the pivot means which permit pivoting about a horizontal axis are disengaged and a second set of pivot means permitting pivoting about a vertical axis is engaged.

In virtually all of the tilt-turn systems heretofore known, it is intended that actuation of the operating means be effected only when the sash and frame are in coplanar alignment, i.e. in the fully closed position of the window. However, in devices heretofore known it is possible, by rotating the operating handle when the sash is not completely closed, to arrive at an operating condition wherein less than all of the pivoting joints which are intended to interact at a given time are, in fact, engaged. More particularly, where it is sought to shift the window device from the vent position to the casement position, it is intended that the window be completely closed before the operating handle is activated to the desired position. With prior art devices, however, it is possible, where the sash is not completely closed, nonetheless to shift the operating handle to the casement position, with the result that, by virtue of the slight misalignment of the parts, the upper vertical pivot component intended to span the space between the sash and the frame fails to be engaged in the frame. Under such circumstances, the window will be free to pivot simultaneously about a horizontal and a vertical axis and will normally be supported solely at a lower edge portion. Such window will then be prevented from falling inwardly solely by the linkage mechanism disposed between the upper edge of the window and the frame. Since the linkage mechanism is not intended to withstand the stresses applied under such circumstances, it is possible that the linkage may be bent and rendered unusable or, more seriously, that the linkage may break and the window fall inwardly.

Since the sash components of windows of the type described are often extremely heavy, at the very least, should the window be misoperated in the manner noted, the readjustment of the window to its correct operating condition is a most difficult task, often requiring the assistance of the window manufacturer or the installer.

A further common failure in prior windows of the type discussed occurs when the operating handle is rotated while the window is in the casement position before the sash and frame have been disposed in coplanar alignment. Such improper operation may result in the condition hereinabove noted, i.e. sash pivoted both horizontally and vertically and supported solely at the permanent pivot joint and by the motion limiting linkage.

SUMMARY OF THE INVENTION

The present invention may be summarized as directed to a window of the tilt and turn type having a single operating handle, characterized in that the same includes safety locking means which positively disable movement of the operating handle when the sash is positioned other than in coplanar alignment with the window frame. The safety mechanism positively precludes shifting of the drive means and, thus, concomitantly precludes disengagement of pivotal connections except when the window sash is properly disposed for such shifting movement.

More particularly, in accordance with the invention, the drive mechanism which functions to release certain pivotal connections and to engage other pivotal connections when the window is shifted from one mode of operation to another, is provided with a locking mechanism which cooperates with a complemental fixture secured to the frame in such manner that whenever the sash is tilted even slightly out of coplanar alignment with the frame, elements of the locking member and fixture are engaged positively to lock the drive means against movement, whereby shifting of the pivots necessary to the changing of conditions of operation of the window is prevented.

Accordingly, it is an object of the invention to provide a tilt-turn window having safety features which ensure the proper performance of the window under all circumstances, notwithstanding attempts improperly to operate the window.

A further object of the invention is the provision of a window of the type described having a simple and effective interlock mechanism interposed between the sash and the frame, which interlock mechanism positively precludes relative movement of the drive means and, hence, the disengagement or engagement of pivot mechanisms, when the window is even slightly ajar in any direction.

To attain these objects and such further objects as may appear herein or be hereinafter pointed out, reference is made to the accompanying drawings, forming a part hereof, wherein:

FIG. 4 is a magnified horizontal section taken on the line 4—4 of FIG. 1 showing the position of the parts of the safety mechanism in the locked condition of the window assembly;

FIG. 5 is a magnified vertical sectional view taken on the line 5—5 of FIG. 4 showing the position of the parts in the locked condition of the assembly;

FIG. 6 is an exploded and magnified vertical section taken on the line 6—6 of FIG. 5 with extraneous parts eliminated to facilitate an understanding of the details of construction;

Figure 1:
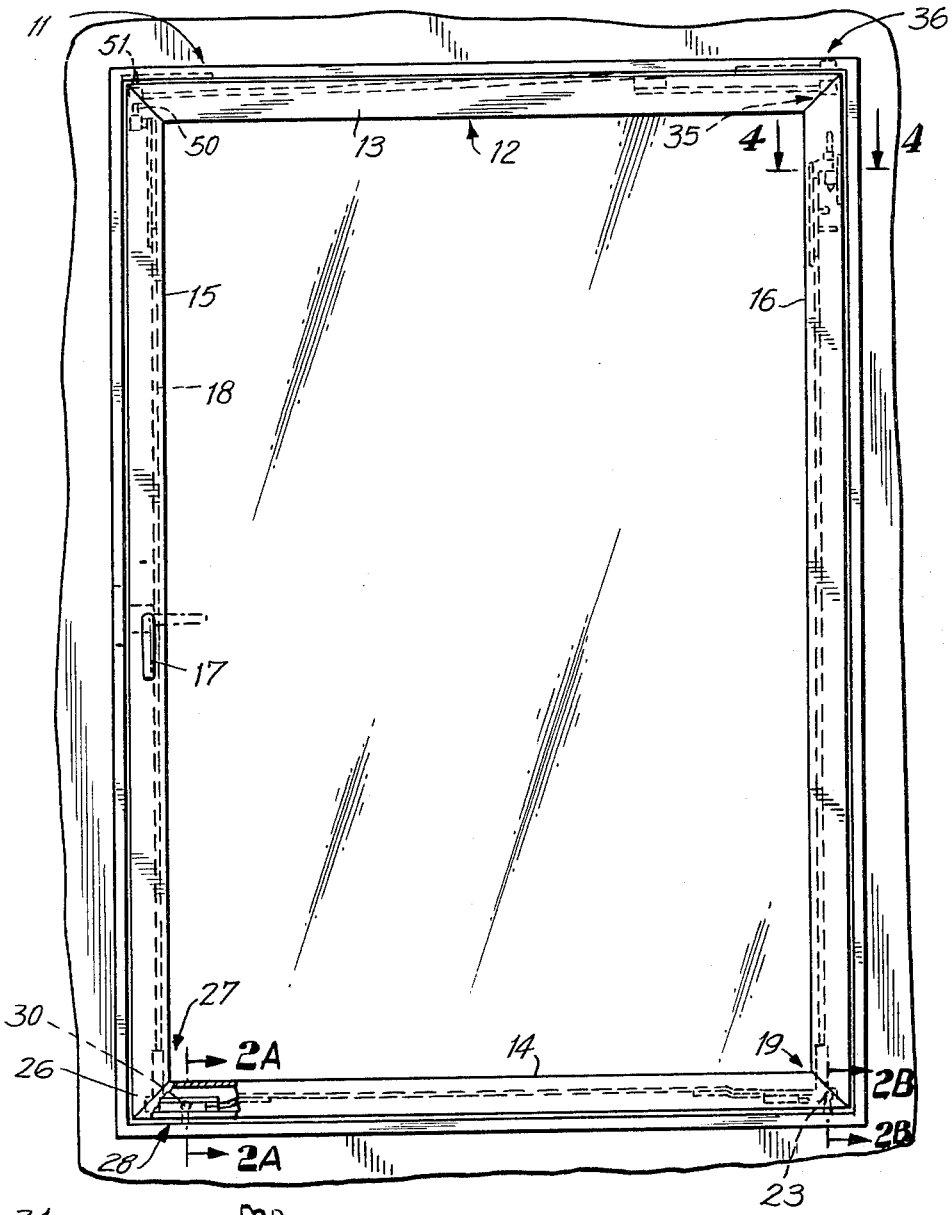
FIG. 1 is a front elevational view of a window assembly in accordance with the invention, with parts of the operating mechanism shown in dot and dash lines.
Figure 7:
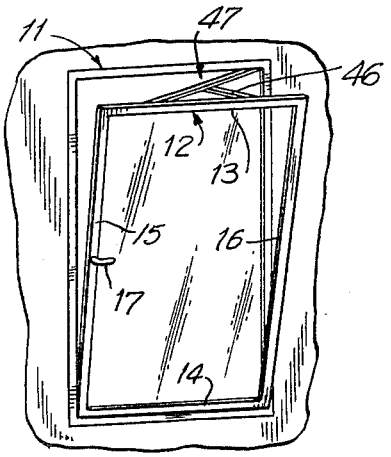
FIG. 7 is a perspective view of the window opened to the vent position.
Figure 10:
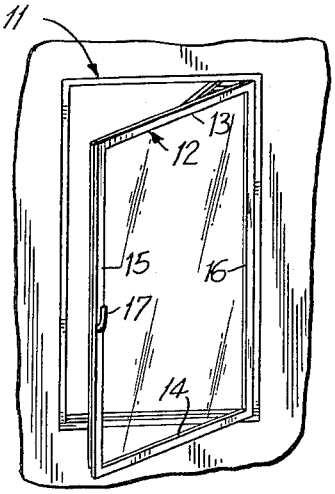
FIG. 10 is a perspective view of the window construction partially opened in the casement condition.

Referring now to the drawings and particularly FIGS. 1, 7 and 10, there is disclosed a tilt and turn window assembly 10 comprising a rectangular frame member 11 structurally secured to a complementally sized opening in a building. A sash member 12 of rectangular configuration and including top and bottom rails 13, 14, respectively, and side rails 15, 16, respectively, is movably secured within the frame 11 in such manner that the sash may be tilted inwardly to a so-called vent position, as shown in FIG. 7 or, alternatively, may be pivoted about a vertical axis to the so-called casement position as shown in FIG. 10.

The sash assembly 12 typically includes one or more lites or panes of glass which optionally may incorporate Venetian blinds or like structures interposed therebetween.

It will be readily recognized that, due to the combined weight of the sash, glass lites, operating mechanism, Venetian blind, etc., the sash assembly may be extremely heavy.

The operating condition of the window assembly is controlled by an operating handle 17 pivotally mounted for rotation about a horizontal axis on the side rail 15. Rotation of the handle 17 about the noted axis functions to shift a drive mechanism or band 18, known per se, which mechanism or band is disposed within the hollow components or rails 13, 14, 15, 16 forming the sash 12.

Since the structure of the drive mechanism per se is known and forms no part of the present invention, a detailed description thereof will not be undertaken. It is believed sufficient to note that the drive mechanism 18 may comprise a flexible continuous or discontinuous steel band or chain guided about the corner portions between adjacent rails.

The handle mechanism 17 is connected to the drive mechanism 18 by a chain and sprocket connection or equivalent such that rotary motion of the handle imparts linear motion to the band defining the drive mechanism whereby the drive mechanism will move up or down within the side rails and side to side within the top and bottom rails, depending upon the direction of rotation of the operating handle.

The articulated movements of the sash 12 within the frame 11 are controlled by a plurality of pivot joints or connections interposed between the sash 12 and the frame 11. Since pivot joints of the general type described and the manner of their operation are known per se, for instance in U.S. Pat. Nos. 3,911,621 and 3,667,162, a description thereof will, for purposes of brevity, be limited to the extent necessary to an understanding of the instant invention.

Figure 2A:
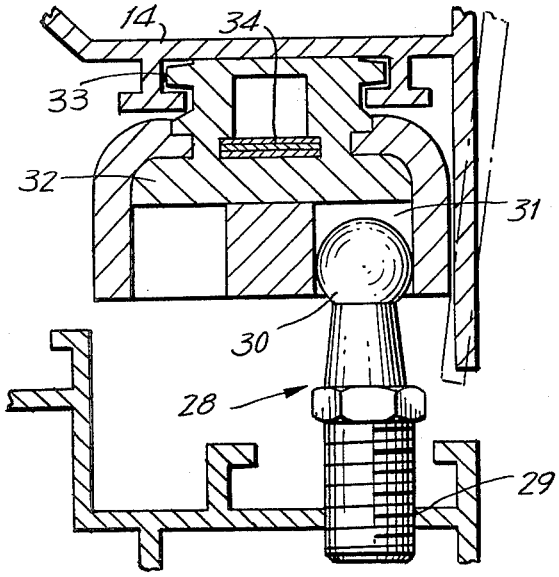
FIG. 2A is a magnified vertical section taken on the line 2A—2A of FIG. 1.
Figure 2B:
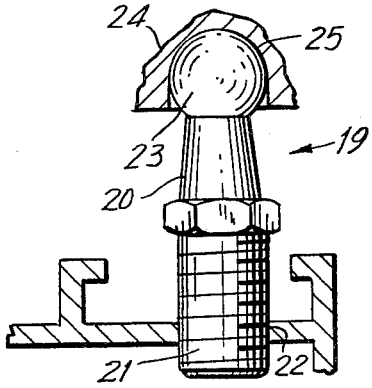
FIG. 2B is a magnified fragmentary section taken on the line 2B—2B of FIG. 1.

The pivot joints include a permanent pivotal connection 19, shown in detail in FIG. 2B, which joint extends between the frame and the lower rail 14 adjacent the corner remote from the operating handle 17 and which remains connected under all conditions of operation of the device. More particularly, the pivot joint 19 includes a stud member 20 having a threaded attachment end 21 heightwisely adjustably mounted in aperture 22 of the frame and provided with a ball member 23 at the uppermost end. The rail member 14 or, more accurately, a casting 24 mounted within the rail, includes a socket 25 within which the ball 23 is movably seated.

It will thus be seen that the rail 14, by reason of the ball and socket joint connection, may be pivoted inwardly, i.e. about a horizontal axis coincident with the radius of the ball, to a substantial degree, and may be rotated about a vertical axis coincident with the radius of the ball through a virtually unlimited amount or degree of pivoting movement.

As best seen in FIG. 2A, there is provided adjacent the lower corner 26 of the sash nearest the operating handle 17 a separable or removable pivot connection or joint 27. The separable or removable pivot connection 27 is provided by a stud fixture 28 similar to the fixture 20 previously described and vertically adjustably supported in aperture 29 formed in a fixed portion of the frame adjacent the corner 26. The stud 28 includes a ball member 30 at its uppermost end. The ball 30 extends upwardly into a chamber 31 formed on a casting 32 slidably guided in guideway 33 formed in the bottom rail section 14. The casting 32 is operatively connected to the steel band 34 forming a component of the drive mechanism 18 whereby, upon rotation of the operating handle 17, the casting 32 will be bodily shifted horizontally along the rail 14.

In FIG. 2A the ball is disclosed to be positioned within the chamber 31 (vent position), whereby a limited pivotal movement of the frame about a horizontal axis coincident with the radius of the balls 30 and 23 is permitted—see dot and dash lines, FIG. 2A.

The casting 32 includes, as is conventional with windows of this sort, a horizontally directed clearance channel (not shown) which aligns with the ball 30 when the operating handle is shifted to the vent position, whereby the sash may be swung inwardly to the position shown in FIG. 10 without interference between the ball 30 and the casting 32.

A further removable joint assembly 35 is formed at the upper right hand corner 36 between the sash and the frame. The removable joint member 35 includes a fitting 37 which is likewise connected to a vertically directed leg of the drive band or assembly 18 whereby fitting 37 shifts upwardly and downwardly responsive to rotation of the operating handle.

Figure 9:
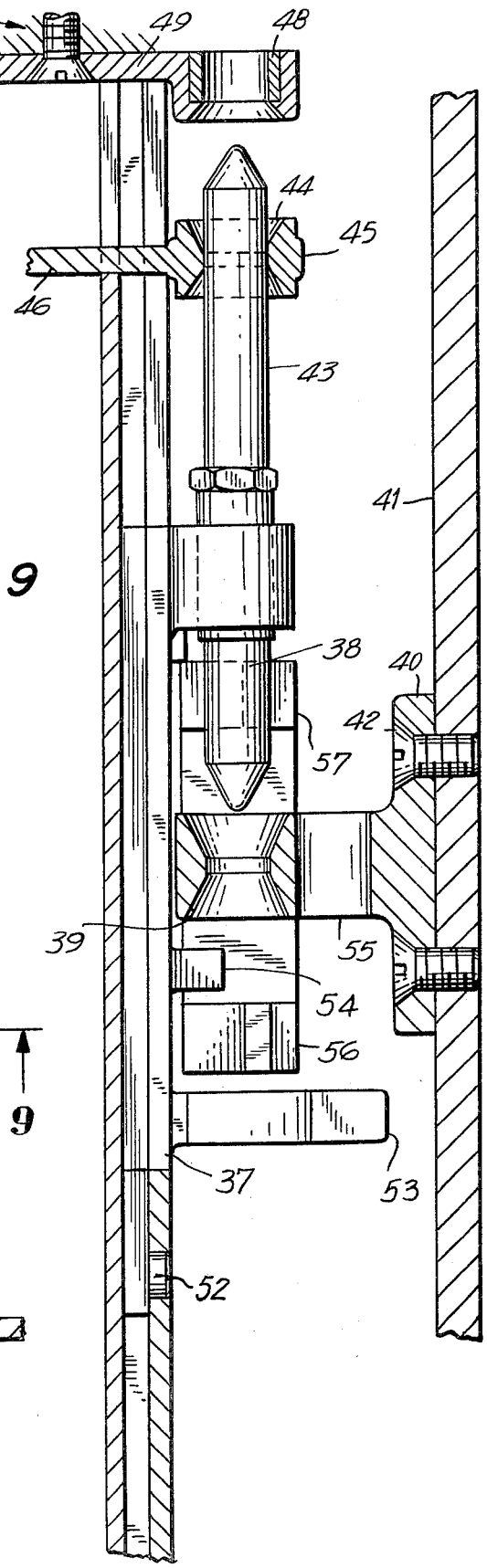
FIG. 9 is a vertical sectional view similar to FIG. 5 showing the condition of the parts in the vent position thereof.
Figure 12:
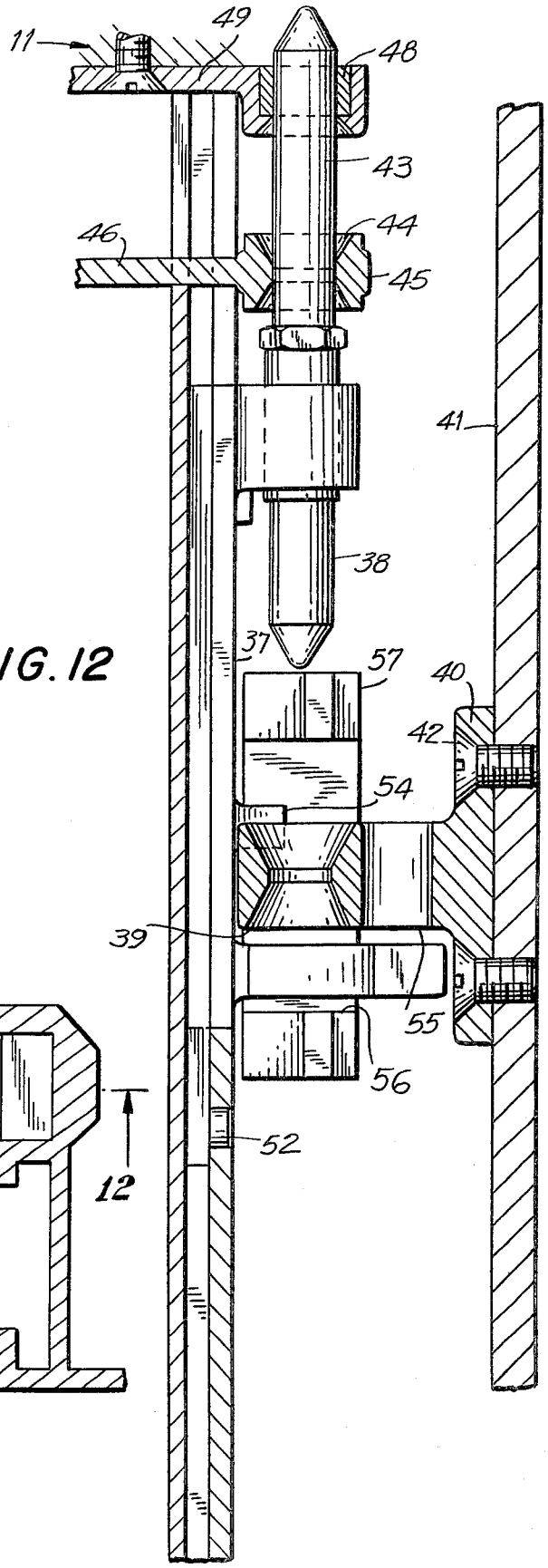
FIG. 12 is a vertical sectional view similar to the views of FIGS. 5 and 9 showing the position of the parts of the safety mechanism in the casement condition.

The three conditions of operation of the fitting 37 are best appreciated from a comparison of FIGS. 5, 9 and 12.

In the closed position depicted in FIG. 5, the fitting is disposed in its lowermost position whereat a depending trunnion 38 carried by the fitting extends into a locking aperture 39 formed on a fixture 40 made fast to the vertical frame component 41, as by mounting screws 42.

When the operating handle is rotated to the intermediate or vent position, FIG. 7, the fitting 37 will be lifted to a position clear of the bearing aperture 39, whereat the interfit of the trunnion 38 and bearing aperture no longer precludes inward tilting movement of the sash about the horizontal axis defined by the balls 23 and 30. It will be further perceived that the fitting 37 carries an upwardly directed second trunnion 43.

In the position of FIG. 9, the upwardly directed trunnion 43 is depicted as having risen to enter a bearing aperture 44 formed on the end 45 of a scissors linkage 46, known per se. The scissors linkage assembly 47, which is shown in FIG. 7, in essence provides a means for limiting the tilting movement of the sash substantially to the extent shown in said FIG. 7, and is a conventional expedient in windows of the type described, as demonstrated by the aforecited prior art patents. The linkage 48, while sufficiently strong to resist or limit inward tilting of the sash when both pivots 26 and 19 are engaged, may be readily damaged if, through some mischance, the window should tilt inwardly simultaneously about vertical and horizontal axes while being supported at the lower end solely by the permanent joint 19, as is possible with the devices of the prior art.

In FIG. 12 the fitting 37 is disclosed in its upwardmost position. In such upwardmost position, the upper trunnion 43 extends into a bearing member 48 forming a part of bracket 49 affixed to the uppermost rail of the frame assembly 11.

The longitudinal axis of the upper and lower trunnions 43 and 38 is aligned vertically above the radius of the ball 23, whereby, when the fitting 37 is positioned by the drive means in the disposition shown in FIG. 12, the sash is free to rotate about the vertical axis defined by said trunnion and ball, and the sash may be pivoted to the position shown in FIG. 10 and beyond, providing access to the exterior face of the glass lite, as for cleaning.

As is further conventional, the drive mechanism 18 may include a locking pin 50 which is vertically shiftable responsive to rotation of the operating handle, the locking pin being disposed in its uppermost or locking position, as shown in FIG. 1, when the handle is in the lock position shown in solid lines in said figure, whereby the same extends into a locking aperture 51 formed in a fixed portion of the frame.

The apparatus as heretofore described is, for the most part, conventional in its construction and operation. In order to appreciate the manner of operation of the safety mechanism to be hereinafter described, it is believed helpful briefly to review the operating positions of the parts in the various conditions of operation of the handle.

A—LOCK—pin 50 disposed in locking aperture 51 and lower trunnion 38 disposed in aperture 39 of fixture 40; ball 30 disposed within locking channel 31.

B—VENT CONDITION—locking pin 50 shifted downwardly clear of aperture 51; lower trunnion 38 lifted clear of aperture 39; ball 30 disposed within laterally shifted locking channel 31; upper trunnion 43 engaged within aperture 44 of scissors linkage 47;

C—CASEMENT CONDITION—locking pin 50 clear of aperture 51; upper trunnion 43 extended upwardly into bearing aperture 48; ball 30 located in horizontal registry with outwardly facing clearance slot formed in further laterally shifted locking channel 31.

Figure 3:
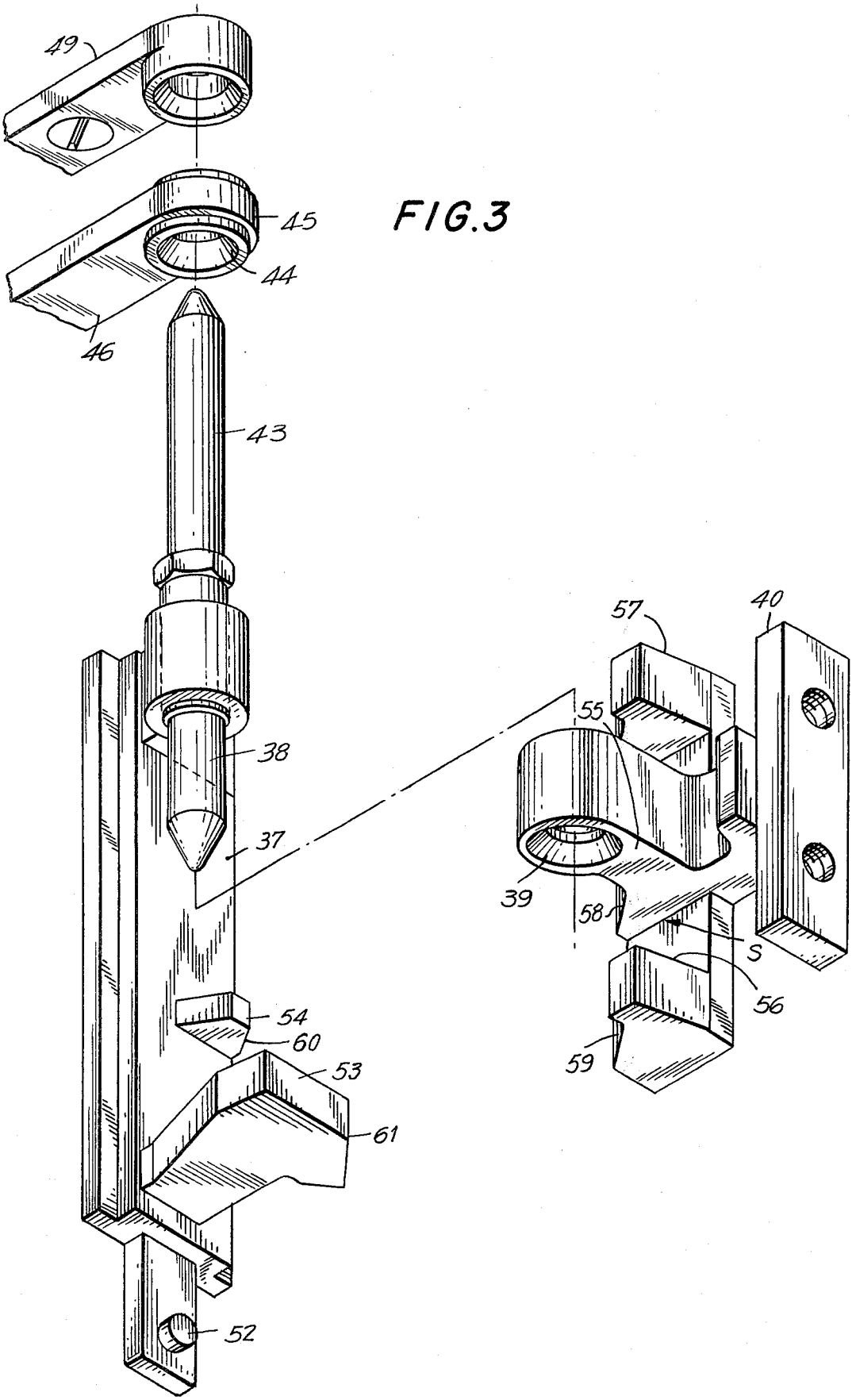
FIG. 3 is an exploded perspective view of the safety locking mechanism in accordance with the invention.

The safety features are provided by the interplay of elements of the movable fitting 37 and the fixture 40. More particularly and by reference specifically to FIG. 3, the fitting 37 which is interconnected to the drive mechanism 18 as by a connector pin 52 engageable with the flexible band 34 of the drive mechanism 18 carries a blocking finger 53. In upwardly spaced relation to the blocking finger 53, the fixture 37 incorporates an abutment member 54.

The fixture 40 has formed interally therewith an upper stop member 55, within which is formed the lower trunnion receiver member 39. In downwardly spaced relation to the upper stop member 55 there is formed a lower stop member 56. Optionally, the fixture 40 may include a third stop member 57 which is similarly spaced from the stop 55 in accordance with the spacing of the stops 55 and 56, whereby the fixture 40 may be inverted for opposite "handing."

The stops 55, 56 are recessed or chamfered as at 58 and 59, respectively. The chamfered areas 58, 59 provide close clearance with the surface 60 of the abutment member 54. The clearance between the noted parts is such that if the sash is not fully closed, i.e. in coplanar alignment with the frame, the abutment 54 cannot shift upwardly past the lower stop 56, i.e. cannot shift from the closed position shown in FIG. 5 to the vent position shown in FIG. 9 since the same will be physically blocked from movement by engagement of the noted parts.

Figure 8:
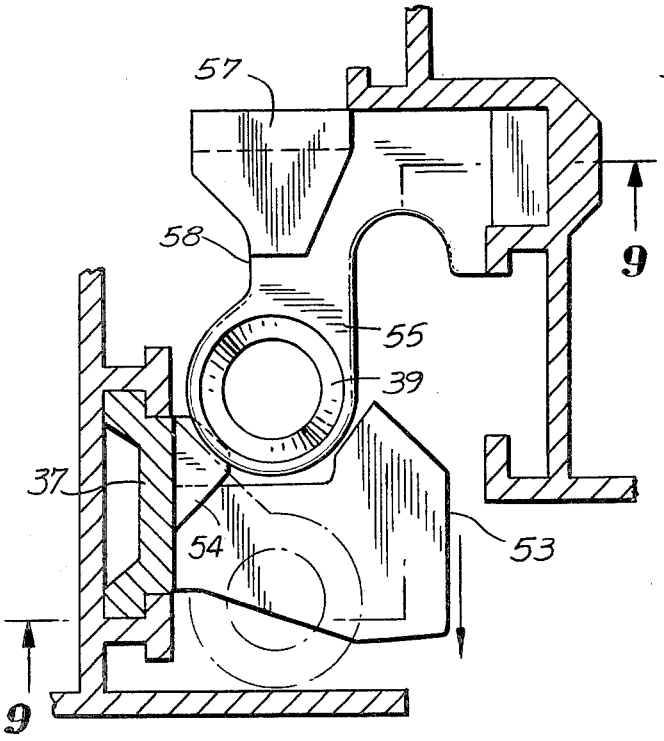
FIG. 8 is a horizontal sectional view similar to the view of FIG. 4 but showing the position of the parts in the vent condition thereof.

Again, assuming the abutment 54 to have been raised to the vent position shown in FIGS. 8 and 9, it will be appreciated that the same lies in the space between the upper and lower stops 55, 56 but when the sash is in coplanar alignment, it will be laterally offset from both of the noted upper and lower stops.

Now assuming that the window is tilted inwardly, as shown in FIG. 7, it will be appreciated, as best seen in FIG. 8, that the inward movement of the abutment 54 will advance said abutment into the slot S formed between the upper and lower stops 55, 56, i.e the abutment will not longer be laterally offset from the stops 55, 56.

In the event that any attempt should be made to rotate the operating handle while the window is vented, it will be observed that the abutment 54 will be blocked from movement either upwardly or downwardly, depending upon the direction of attempted rotation of the handle, by engagement with one or another of the stops 55, 56.

It will thus be evident that in order to shift the operating handle from the vent position, it will again be necessary completely to shut the window so that it is in coplanar alignment with the frame, whereby the abutment 54 will be cleared from vertical alignment with the stops 55, 56, whereby the operating handle is freed to shift the fitting 37 either downwardly to return the same to the locked position of the window or upwardly to the casement condition thereof.

Assuming next that the window and frame are in coplanar alignment and it is desired to shift the same to the casement position, the locking handle 17 is rotated to its upwardmost condition as shown in FIG. 1. Such rotation is made possible since, in the closed position of the window, the abutment 54 and finger 53 are in a position laterally offset from the stops 55, 56.

Figure 11:
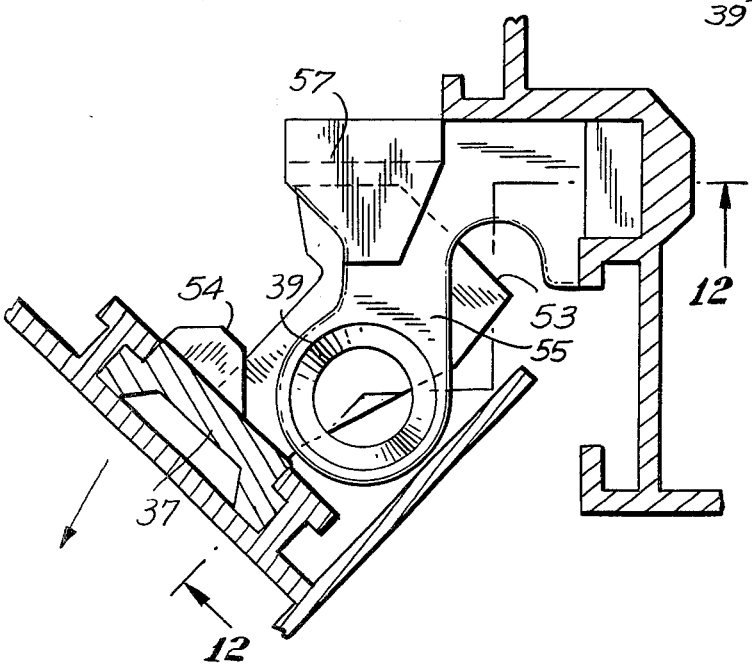
FIG. 11 is a view similar to the views of FIGS. 4 and 8 showing the position of the parts of the safety mechanism in the casement condition.

When the parts are shifted to the casement position as shown in FIGS. 10, 11 and 12, it will be perceived that the blocking finger 53 is now in alignment with the slot S between stops 55 and 56. By virtue of the configuration of the chamfers 58 and 59 and the bevel 61 on the blocking finger, the blocking finger may be shifted upwardly past the chamfer 59 of the lower stop 56, the finger 53 being laterally offset from the slot S so long as the sash is in coplanar alignment with the frame. However, as best seen from an inspection of FIGS. 11 and 12, as soon as any pivotal movement about the vertical axis of the sash has been effected, portions of the fan shaped finger 53 are pivoted laterally into the slot S defined between the upper and lower blocking portions 55, 56.

It will thus be appreciated that any attempt to rotate the operating handle after the sash has been pivoted even slightly in the casement condition will result in the finger 53 being blocked from movement upwardly or downwardly by the upper and lower stops 55, 56, respectively. Accordingly, further movements of the operating handle 17 and drive means 18 are positively prevented by the interference between the blocking finger 53 and the stops 55, 56.

From the foregoing description it will be appreciated that there is disclosed a construction in which any movements of the drive mechanism which controls the releasible pivot joints are positively prevented when the sash is in any position other than in coplanar alignment with the frame. As noted, such positive blocking movements are effected in the vent position by tilting movements introducing the abutment 54 into the slot between upper and lower stops 55, 56.

In the casement position, the slightest pivotal movement of the sash about a vertical axis introduces portions of the finger 53 into the space between stops 55, 56, whereby shifting movement of the drive mechanism and handle is precluded by the interaction of the finger and stops.

As will be understood from the described construction, there is formed a tilt and turn window assembly wherein misoperation is positively prevented and operator error cannot result in a condition wherein less than two vertical pivots or less than two horizontal pivots are simultaneously engaged.

As will be apparent to those skilled in the art who have been familiarized with the instant disclosure, numerous variations and modifications may be made in the illustrated and described construction without departing from the spirit of the invention. Accordingly, the invention is to be broadly construed within the scope of the appended claims.

Having thus described the invention and illustrated its use, what is claimed as new and is desired to be secured by Letters Patent is:

1. A safety window construction of the type which is shiftable between locked, vent and casement conditions of operation, said window including a fixed rectangular frame, a movable hollow rectangular sash pivotally connected thereto and carrying a pane, an operating handle on said sash shiftable between locking, vent and casement positions, drive means in said hollow sash operatively connected to said handle, a permanent pivot connection between a lower corner of said sash and frame permitting horizontal and vertical pivotal movements of said sash relative to said frame, a removable pivot connection between the other lower corner of said sash and frame and operatively associated with said drive means, permitting movement about a horizontal axis between said sash and frame in said vent condition and clearing said sash for horizontal movement relative to said frame in said casement condition, and a third pivot connection including a bearing aperture on said frame in coaxial alignment with said permanent connection, and a trunnion member formed on a fitting movably mounted on said sash and operatively connected to said drive means, said trunnion member being in axial alignment with said bearing aperture and shiftable axially thereinto responsive to movement of said handle to said casement condition, said window being characterized in that said frame includes a fixture mounted thereon having vertically spaced stop portions defining a horizontal clearance slot, said fitting including a finger member located in lateral displaced relation to and in horizontal alignment with said slot in said casement position of said handle when said sash is in a coplanar aligned condition with said frame, said finger being positioned to be shifted into said slot responsive to pivotal movements of said sash about said vertical axis away from said coplanar aligned condition, whereby vertical movements of said fitting are positively prevented by interference between said finger and stop portions, thus to lock said trunnion from removal from said bearing aperture.

2. A window construction in accordance with claim 1 wherein said fitting includes an abutment portion disposed, in the vent position of said handle, in laterally offset relation to and in horizontal alignment with said slot, said abutment portion being positioned to shift into said slot responsive to tilting movements of said sash about said horizontal axis from said coplanar aligned condition, whereby said drive means is locked against movement relative to said sash.

3. A window construction in accordance with claim 2 wherein said fixture includes a second bearing member in alignment with said vertical axis, and said fitting includes a second trunnion, said second trunnion being disposed in said second bearing member in said locked condition of said window.

4. A window construction in accordance with claim 3 wherein said second bearing member is formed in one of said stop portions.

5. A safety window construction including a fixed rectangular frame and a hollow movable rectangular sash, said construction being of the type in which said sash is shiftable between a locked position wherein said sash is in coplanar alignment with said frame, a vent position whereat said sash is tiltable about a horizontal axis relative to said frame and a casement position whereat said sash is pivotable about a vertical axis relative to said frame, said window construction including an operating handle on said sash and pivotable relative thereto progressively from a locking to a vent, and to a casement position, drive means within said sash operatively connected to said handle, permanent pivot connection means extending between a lower corner of said sash and an adjacent frame portion, permitting pivotal movements of said sash relative to said frame about a horizontal and a vertical axis, a first removable pivot connection operatively connected to said drive means for enabling pivotal movement of said sash relative to said frame about said horizontal axis responsive to movement of said handle to said vent position, a second removable pivot connection interposed between said sash and said frame and operatively connected to said drive means for permitting vertical pivotal movement of said sash relative to said frame when said handle is in said casement position, and normally inoperative lock means interposed between said drive means and said frame for locking said drive means against movement relative to said sash responsive to movement of said sash from said coplanar aligned position with said frame, said lock means comprising a fixture mounted to said frame and including first and second spaced-apart stop portions defining a clearance slot, and a fitting secured to said drive means adjacent said fixture, said fitting including at least one abutment portion disposed in laterally spaced relation to said slot in said coplanar aligned position of said sash and frame and projected into said slot responsive to movement of said sash from said coplanar aligned position.

6. A safety window in accordance with claim 5 wherein said fixture is mounted on a vertical portion of said frame and said slot is horizontally disposed, and said fitting includes a first abutment in vertical alignment with said slot in said vent position and a second abutment in vertical alignment with said slot in said casement position.

7. A window construction in accordance with claim 6 wherein said fitting includes a trunnion portion defining a component of said second removable pivot connection.

8. A window construction in accordance with claim 7 wherein one of said stop portions includes a vertically directed bearing aperture and said fitting includes a second trunnion portion disposed within said bearing aperture in the locked condition of said sash.

* * * * *